US010285439B2

(12) United States Patent
Macko et al.

(10) Patent No.: US 10,285,439 B2
(45) Date of Patent: May 14, 2019

(54) SMOKELESS TOBACCO PACKAGING SYSTEM AND METHOD

(71) Applicant: Altria Client Services LLC, Richmond, VA (US)

(72) Inventors: Jason Andrew Macko, Richmond, VA (US); James Lindsay Clark, Richmond, VA (US); Shannon Maxwell Black, Richmond, VA (US); Andrew Nathan Carroll, Chester, VA (US); Srinivasan Janardhan, Glen Allen, VA (US)

(73) Assignee: Altria Client Services LLC, Richmond, VA (US)

( * ) Notice: Subject to any disclaimer, the term of this patent is extended or adjusted under 35 U.S.C. 154(b) by 246 days.

(21) Appl. No.: 15/266,502

(22) Filed: Sep. 15, 2016

(65) Prior Publication Data

US 2017/0224012 A1 Aug. 10, 2017

Related U.S. Application Data

(62) Division of application No. 13/315,561, filed on Dec. 6, 2011, now Pat. No. 9,468,233.
(Continued)

(51) Int. Cl.
*A24F 23/00* (2006.01)
*A24B 13/00* (2006.01)
(Continued)

(52) U.S. Cl.
CPC ..... *A24F 23/00* (2013.01); *A24B 13/00* (2013.01); *B65B 7/28* (2013.01); *B65B 29/00* (2013.01); *B65B 63/02* (2013.01)

(58) Field of Classification Search
None
See application file for complete search history.

(56) References Cited

U.S. PATENT DOCUMENTS 114,901 A 5/1871 Alden
203,363 A 5/1878 Muth
(Continued)

FOREIGN PATENT DOCUMENTS

JP 2009-508523 3/2009
JP 2009-517647 4/2009
(Continued)

OTHER PUBLICATIONS

International Search Report and Written Opinion for Application No. PCT/US2011/032329, dated Aug. 17, 2011, 12 pages.
(Continued)

*Primary Examiner* — Michael J Felton
(74) *Attorney, Agent, or Firm* — Harness, Dickey & Pierce, P.L.C.

(57) ABSTRACT

Some embodiments of a smokeless tobacco system include a container including a plurality of preformed smokeless tobacco products configured to generally retain their shape and integrity during processing, shipping, and consumer handling. One or more of the preformed smokeless tobacco products are compressed between a lid and a base of the container to hinder movement of the one or more preformed smokeless tobacco products within the container. Each preformed smokeless tobacco product can include a moist smokeless tobacco in combination with a selected binder such that the final product is configured to have material properties providing improved handling, an improved mouth feel, and a satisfying flavor profile.

24 Claims, 5 Drawing Sheets

Related U.S. Application Data

(60) Provisional application No. 61/421,950, filed on Dec. 10, 2010.

(51) Int. Cl.

| | |
|---|---|
| ***B65B 7/28*** | (2006.01) |
| ***B65B 29/00*** | (2006.01) |
| ***B65B 63/02*** | (2006.01) |

(56) References Cited

U.S. PATENT DOCUMENTS

| | | | |
|---|---|---|---|
| 639,366 | A | 12/1899 | Dudley |
| 865,026 | A | 9/1907 | Ellis |
| 904,521 | A | 11/1908 | Ellis |
| D56,903 | S | 1/1921 | Wentz |
| D56,913 | S | 1/1921 | Edgerton |
| 1,376,586 | A | 5/1921 | Schwartz |
| D101,888 | S | 11/1936 | Ringold |
| D133,008 | S | 7/1942 | McCall |
| 2,826,906 | A | 3/1953 | Rice |
| 2,635,273 | A | 4/1953 | Logan |
| 2,708,175 | A | 5/1954 | Samfield et al. |
| 2,887,414 | A | 5/1959 | Rosenberg et al. |
| 3,016,907 | A | 1/1962 | Rosenberg et al. |
| 3,693,629 | A | 9/1972 | Broughton |
| 4,081,394 | A | 3/1978 | Bartley |
| 4,098,421 | A | 7/1978 | Foster |
| 4,144,894 | A | 3/1979 | Schmidt et al. |
| D258,091 | S | 1/1981 | Reed et al. |
| 4,317,837 | A | 3/1982 | Kehoe et al. |
| 4,459,987 | A | 7/1984 | Pangburn |
| 4,513,756 | A | 4/1985 | Pittman et al. |
| 4,545,392 | A | 10/1985 | Sensabaugh, Jr. et al. |
| 4,572,222 | A | 2/1986 | Pangburn |
| 4,596,259 | A | 6/1986 | White et al. |
| 4,624,269 | A | 11/1986 | Story et al. |
| 4,712,552 | A | 12/1987 | Pangburn |
| 4,917,161 | A | 4/1990 | Townend |
| 4,972,855 | A | 11/1990 | Kuriyama et al. |
| 5,387,416 | A | 2/1995 | White et al. |
| D377,085 | S | 12/1996 | Tortarolo |
| 5,584,306 | A | 12/1996 | Beauman et al. |
| 5,651,642 | A | 7/1997 | Kelley, Jr. et al. |
| 5,679,467 | A | 10/1997 | Priluck |
| 5,873,206 | A | 2/1999 | Roberts |
| 5,955,417 | A | 9/1999 | Taylor |
| D419,261 | S | 1/2000 | Binstock et al. |
| D420,171 | S | 2/2000 | Fauerbach et al. |
| D430,285 | S | 8/2000 | Chen et al. |
| D430,662 | S | 9/2000 | Kobayashi |
| D467,385 | S | 12/2002 | Crawford |
| D490,565 | S | 5/2004 | Ali |
| 6,817,154 | B2 | 11/2004 | Dolan et al. |
| 6,834,654 | B2 | 12/2004 | Williams |
| 6,877,290 | B2 | 4/2005 | Mason |
| 7,073,476 | B2 | 7/2006 | Yamamura et al. |
| D534,646 | S | 1/2007 | Chang et al. |
| D535,017 | S | 1/2007 | Stawski et al. |
| D537,363 | S | 2/2007 | Petrucci |
| D538,472 | S | 3/2007 | Angeletta |
| D538,973 | S | 3/2007 | Angeletta |
| D564,086 | S | 3/2008 | Nielsen et al. |
| D574,516 | S | 8/2008 | Bouchard |
| D610,674 | S | 2/2010 | Karolak et al. |
| 7,661,433 | B2 | 2/2010 | Calandro et al. |
| D624,437 | S | 9/2010 | Leclezio |
| 7,810,507 | B2 | 10/2010 | Dube et al. |
| D630,525 | S | 1/2011 | Patel et al. |
| 7,983,465 | B2 | 7/2011 | Leroux et al. |
| D646,734 | S | 10/2011 | Findeisen |
| 8,033,425 | B2 | 10/2011 | Gerlardi |
| D674,134 | S | 1/2013 | Carroll et al. |
| D674,536 | S | 1/2013 | Macko et al. |
| D674,537 | S | 1/2013 | Macko et al. |
| D674,538 | S | 1/2013 | Macko et al. |
| 8,370,112 | B2 | 2/2013 | Wrede et al. |
| 2004/0062838 | A1 | 4/2004 | Catellanos et al. |
| 2004/0074192 | A1 | 4/2004 | Mason |
| 2004/0118422 | A1 | 6/2004 | Lundin et al. |
| 2004/0123873 | A1 | 7/2004 | Calandro et al. |
| 2004/0217024 | A1 | 11/2004 | Arnarp et al. |
| 2005/0091940 | A1 | 5/2005 | Whitson |
| 2005/0244521 | A1 | 11/2005 | Strickland et al. |
| 2006/0191548 | A1 | 8/2006 | Strickland et al. |
| 2007/0062549 | A1 | 3/2007 | Holton, Jr. et al. |
| 2007/0186941 | A1 | 8/2007 | Holton, Jr. et al. |
| 2008/0029110 | A1 | 2/2008 | Dube et al. |
| 2008/0149121 | A1 | 6/2008 | Wrenn et al. |
| 2008/0187143 | A1 | 8/2008 | Essen |
| 2008/0206432 | A1 | 8/2008 | Torrens et al. |
| 2008/0209586 | A1 | 8/2008 | Nielsen et al. |
| 2008/0298902 | A1 | 12/2008 | Knudson et al. |
| 2009/0025738 | A1 | 1/2009 | Mua et al. |
| 2009/0025739 | A1 | 1/2009 | Brinkley et al. |
| 2009/0065013 | A1 | 3/2009 | Essen et al. |
| 2009/0133703 | A1 | 5/2009 | Strickland et al. |
| 2009/0133704 | A1 | 5/2009 | Strickland et al. |
| 2009/0293889 | A1 | 12/2009 | Kumar et al. |
| 2009/0301028 | A1 | 12/2009 | Pfoff |
| 2009/0306938 | A1 | 12/2009 | Wrede et al. |
| 2010/0000888 | A1 | 1/2010 | Cronin et al. |
| 2010/0101170 | A1 | 4/2010 | Mancine |
| 2010/0187143 | A1 | 7/2010 | Essen et al. |
| 2010/0263310 | A1 | 10/2010 | Wauhop |
| 2010/0294291 | A1 | 11/2010 | Robinson et al. |
| 2011/0023403 | A1 | 2/2011 | Joslyn et al. |
| 2011/0247640 | A1 | 10/2011 | Beeson et al. |
| 2011/0265414 | A1 | 11/2011 | Ciccarelli |
| 2012/0024301 | A1 | 2/2012 | Carroll |
| 2012/0031416 | A1 | 2/2012 | Atchley et al. |
| 2012/0125354 | A1 | 5/2012 | Byrd et al. |
| 2012/0167902 | A1 | 7/2012 | Macko et al. |

FOREIGN PATENT DOCUMENTS

| | | |
|---|---|---|
| JP | 2010-534475 | 11/2010 |
| WO | WO 2006/127772 | 11/2006 |
| WO | WO 2007/037962 | 4/2007 |
| WO | WO 2009/015142 | 1/2009 |
| WO | WO 2009/068279 | 6/2009 |
| WO | WO 2010/025819 | 3/2010 |
| WO | WO 2010/060723 | 6/2010 |
| WO | WO 2010/060845 | 6/2010 |
| WO | WO 2010/086010 | 8/2010 |
| WO | WO 2011/130414 | 10/2011 |

OTHER PUBLICATIONS

Koch, Wendy, Tobacco 'Orbs' Melt in Mouth, Dec. 26, 2008, USA Today, www.usatoday.com, pp. 1-2.

Petersik, Sherry, Our Cheap-o Patio Makeover, May 26, 2009, www.younghouselove.com, p. 5.

Indian Office Action for corresponding Application No. 5301/CHENP/2013 dated Jan. 22, 2019, English translation thereof.

SMOKELESS TOBACCO PACKAGING SYSTEM AND METHOD

CROSS-REFERENCE TO RELATED APPLICATIONS

This application is a divisional of U.S. application Ser. No. 13/315,561, filed on Dec. 9, 2011, which claims the benefit of priority under 35 U.S.C. § 119(e) to U.S. application Ser. No. 61/421,950 filed Dec. 10, 2010. The prior applications are incorporated herein by reference in their entirety.

TECHNICAL FIELD

This disclosure relates to a preformed smokeless tobacco product packaging system that allows for improved product stability during packaging, shipping, and handling.

BACKGROUND

Smokeless tobacco is tobacco that is placed the mouth and not combusted. There generally are considered to be three types of smokeless tobacco: chewing tobacco, moist smokeless tobacco, and dry snuff. Chewing tobacco is coarsely divided tobacco leaf that is typically packaged in a large pouch and used in a plug or twist. Moist smokeless tobacco is a moist, more finely divided tobacco that is provided in loose form or in a pouch form and is typically packaged in round cans and used as a pinch or in a pouch placed between the cheek and gum. Dry snuff is finely ground tobacco that is placed in the mouth or used nasally.

SUMMARY

Some embodiments of a smokeless tobacco packaging system include a plurality of preformed smokeless tobacco products configured within a container to generally retain their shapes during packaging, shipping, and adult tobacco consumer handling. The container includes a lid and a base that defines an interior space. One or more of the preformed smokeless tobacco products are compressed between the container's lid and the container's base to hinder movement of the one or more preformed smokeless tobacco products within the container. The products can become compressed between the lid and the base due to the expansion of shaped bodies into the products after the container is closed. In such circumstances, the packaging system can reduce the likelihood of deformation or damage to the preformed smokeless tobacco products that might otherwise result the products shifting in the container in response to a jarring movement.

In particular embodiments, each preformed smokeless tobacco product can include moist smokeless tobacco in combination with a selected binder such that the preformed tobacco portion can be handled by a consumer but can also provide an improved mouth feel and a satisfying flavor profile. Each of the smokeless tobacco products can have a substantially similar shape and can provide a substantially similar, predetermined portion of tobacco to an adult tobacco consumer's mouth. Such a system can permit an adult tobacco consumer to receive consistent portions of tobacco (e.g., with each deposit of a product portion in the mouth) while also experiencing the tactile and flavor benefits of having the smokeless tobacco externally exposed on the article (e.g., not impeded by a paper or paper-like pouch). Accordingly, some embodiments of the preformed smokeless tobacco product enable an adult tobacco consumer to handle each individual preformed piece from the container without the tobacco portion falling apart prior to placement in the adult tobacco consumer's mouth.

In some embodiments, a method of packaging a smokeless tobacco product includes compressing a mixture of tobacco and a binder into a plurality of shaped smokeless tobacco bodies and depositing the plurality of shaped smokeless tobacco bodies into a base of a container while the bodies are in a compressed state. Each shaped smokeless tobacco body has a substantially similar predetermined shape and is adapted to expand to an expanded size after being compressed. The lid is applied to the base before each shaped smokeless tobacco body expands to the expanded size. The shaped smokeless tobacco bodies subsequently expand such that one or more of the preformed smokeless tobacco products are compressed between the base and the lid to secure said one or more of the bodies in a substantially stationary position relative to the base and the lid. This method can further include a step of sealing the lid to the base.

The details of one or more embodiments are set forth in the accompanying drawings and the description below. Other features, objects, and advantages will be apparent from the description and drawings, and from the claims.

DESCRIPTION OF DRAWINGS

FIG. 2A also depicts how a user can grasp a preformed smokeless tobacco product from the container.

Like reference symbols in the various drawings indicate like elements.

DETAILED DESCRIPTION

Figure 1:
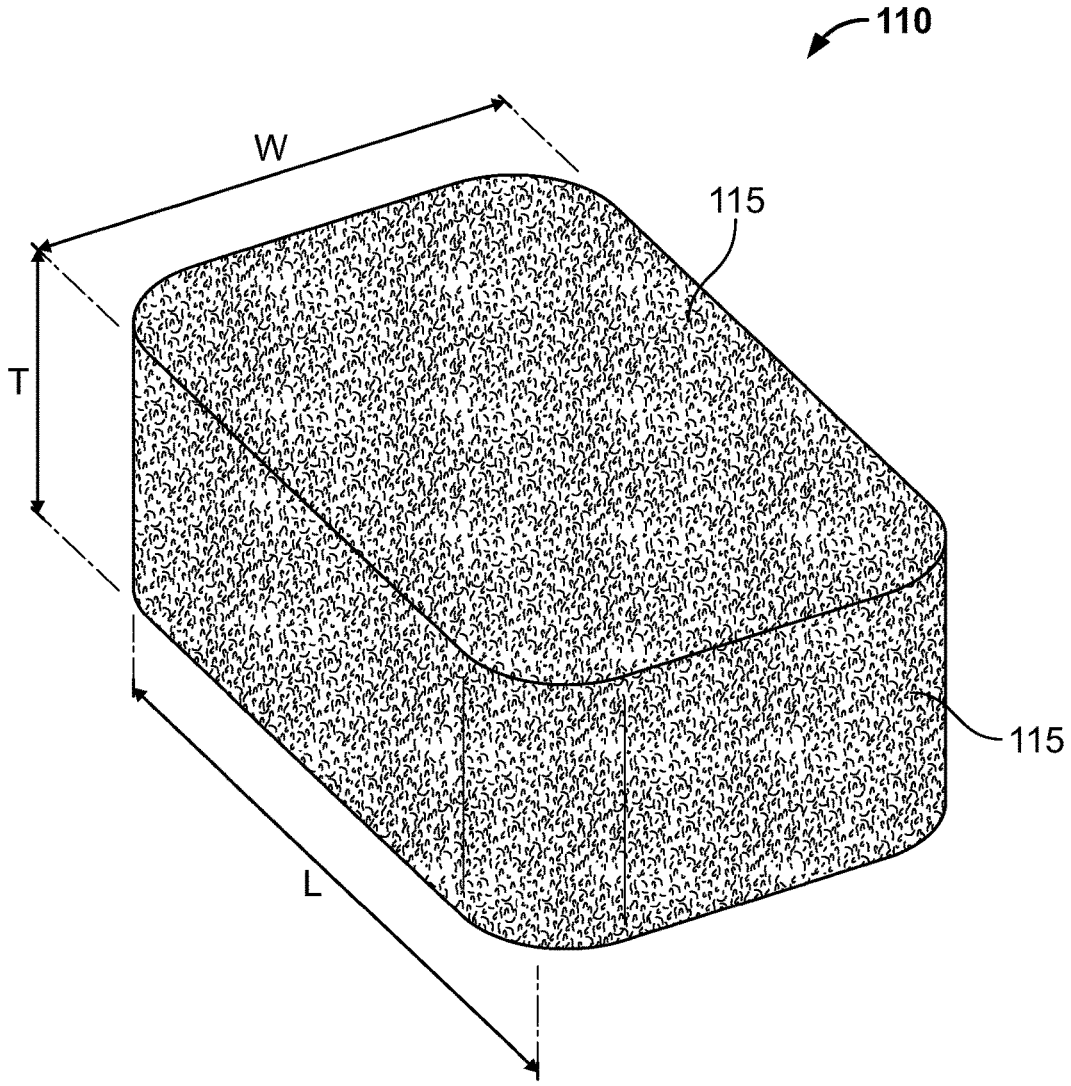
FIG. 1 is a perspective view of an embodiment of a preformed smokeless tobacco product with a predetermined shape.
Figure 2A:
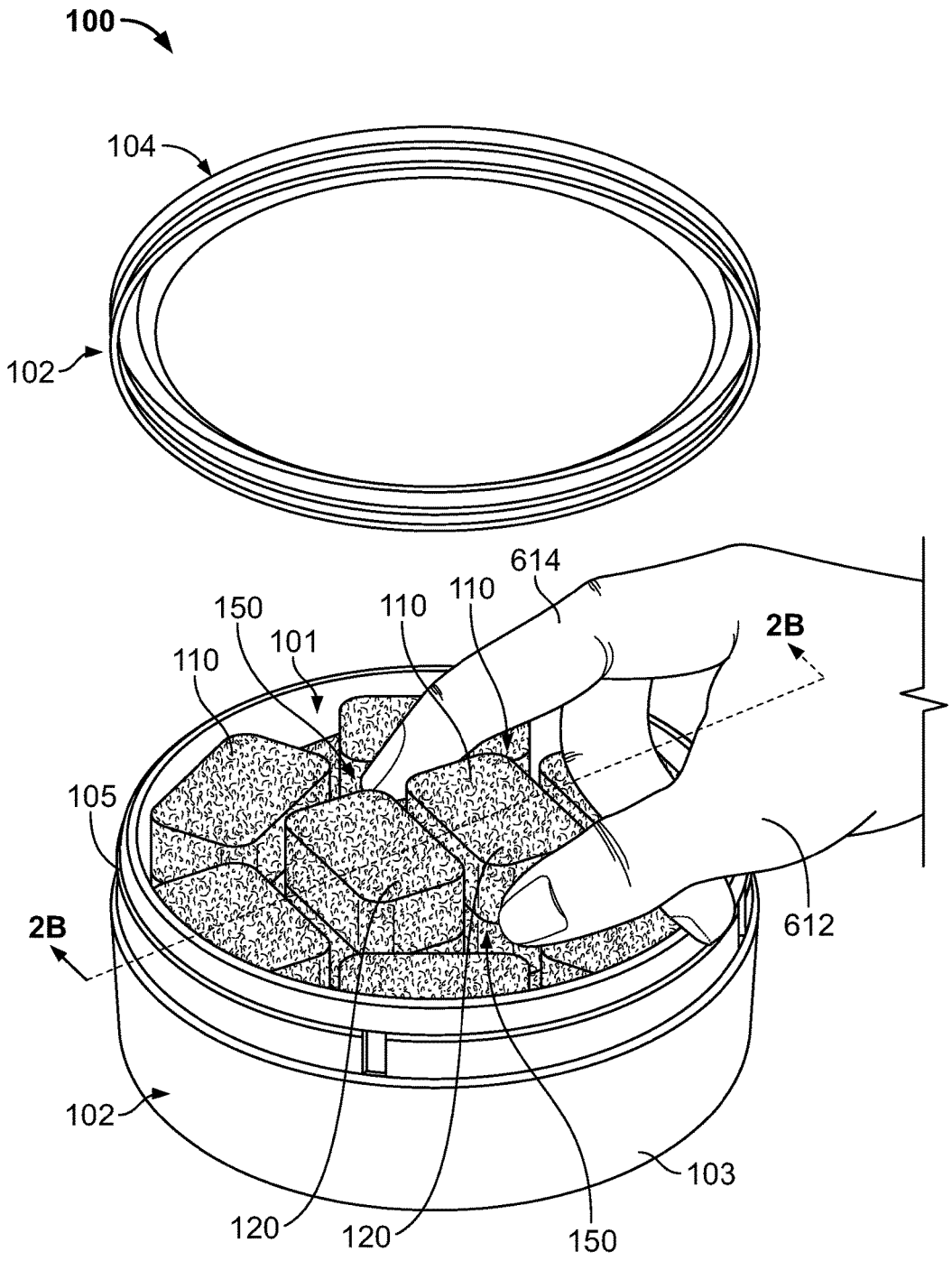
FIG. 2A is a schematic depicting a substantially cylindrical container retaining a plurality of preformed smokeless tobacco products, each with a substantially similar shape.

Referring to FIG. 1 and FIG. 2A, some embodiments of a smokeless tobacco system 100 can include one or more preformed smokeless tobacco products 110 arranged in an interior space 101 of a container 102 that includes a base 103 and a lid 104. Some embodiments of the preformed smokeless tobacco product 110 can include a smokeless tobacco 115 combined with one or more selected binders. The smokeless tobacco 115 and the one or more binders are compressed or molded into a convenient shape prior to packing so that a predetermined portion of the smokeless tobacco 115 is retained by the shaped product 110 yet still exposed on an exterior surface of the shaped product 110.

The preformed smokeless tobacco product 110 described herein may have a beneficial combination of material properties that enhances tobacco satisfaction and allows for improved tactile and flavor benefits. For example, the preformed smokeless tobacco product 110 retains its shape during processing, shipping, and adult tobacco consumer handling, thus permitting an adult tobacco consumer to handle an individual preformed smokeless tobacco product without any loss of integrity of the product prior to use. In addition, each of the smokeless tobacco products 110 in the container 102 of the system 100 (FIG. 2A) may have a substantially similar shape and may also provide a substantially similar, predetermined portion of tobacco for an adult tobacco consumer's mouth. Accordingly, the system 100 enables an adult tobacco consumer to receive consistent portions of tobacco (e.g., with each deposit of the selected product 110 in the mouth) while also experiencing the tactile and flavor benefits of having the smokeless tobacco externally exposed on the article (e.g., not retained inside a paper-like pouch or sachet). Additionally, in some embodiments, the binder employed in the smokeless tobacco product 110 can enhance the release and/or duration of flavors. This unique combination of handling properties, mouth feel, and flavor release can improve the smokeless tobacco experience.

Smokeless tobacco products can become subjected to various jarring forces between the time in which the smokeless tobacco product is packaged and the time in which the adult tobacco consumer opens the container to use the smokeless tobacco product. These jarring forces, if strong enough, can disrupt preformed smokeless tobacco products, causing the preformed smokeless tobacco products 110 to fracture or crumble. These forces can be compounded if the preformed smokeless tobacco products move freely within a container. On the other hand, packing of preformed smokeless tobacco products that is too tight can impede access to each preformed smokeless tobacco product 110 by an adult tobacco consumer.

Accordingly, the preformed smokeless tobacco product packaging system 100 can include one or more preformed smokeless tobacco products 110 placed between a base 103 and a lid 104 of the container 102 and upon relaxation (expansion) of the preformed smokeless tobacco products 110, results in a sufficient but not excessive amount of compression on the products 110. Examples of such packaging systems are describe in more detail below, for example, in connection with FIGS. 2A-B and 3A-B. When under compression in the container 102, the one or more preformed smokeless tobacco products 110 exert a force on the inner surfaces of the lid 104 and the base 103 and thus hinder the movement of the one or more preformed smokeless tobacco products within the container's interior space 101. Accordingly, the one or more of the preformed smokeless tobacco products 110 are compressed between the lid 104 and the base 103 in response to engagement of the lid 104 and the base 103 so as to secure the compressed tobacco products 110 in a substantially stationary position within the interior space 101. The amount of compression, however, preferably is less than the amount required to plastically deform or fracture any of the preformed smokeless tobacco products 110.

Each of the preformed smokeless tobacco products 110 can be molded into a selected shape. After being released from the mold, the shaped smokeless tobacco bodies 110' can relax and thus expand in size. The amount of expansion can depend on the particular tobacco material, the particular binder, other additives, the amount of each ingredient, and the amount of pressure used during the molding operation. In some embodiments, the molded smokeless tobacco product can expand by about 0.04 inches (i.e., about 1 mm) in each dimension. This expansion can be used to generate the compression of the one or more preformed smokeless tobacco products between the lid 104 and the base 103. As discussed below, the container's lid 104 can be applied to the container's base 103 prior to the full relaxation and expansion of the shaped smokeless tobacco bodies 110'. The container 102 can be dimensioned such that it can provide a compressive force once the one or more preformed smokeless tobacco products 110 relax to an expanded size, but the lid 104 can be applied prior to the relaxation to avoid any initial pressure against the shaped smokeless tobacco bodies 110'. The preformed smokeless tobacco products 110 can thus be packaged in a manner that results in compression of one or more of the products 110 between the lid 104 and the base 103 without plastically deforming or fracturing the preformed smokeless tobacco products 110 during the initially attachment of the lid 104 and the base 103. However, subsequently thereto, the engagement of the lid 104 and the base 103 causes the compression of the one or more of the preformed smokeless tobacco products 110 within the container 102 (because the preformed smokeless tobacco products 110 expand after the initial packaging and urge against opposite walls of the container 102).

Different embodiments of the preformed smokeless tobacco products 110 can have a variety of different specific combinations of ingredients. The ingredients determine, at least in part, the material properties of the preformed smokeless tobacco products 110. The preformed smokeless tobacco product can also have a variety of predetermined shapes and dimensions. For example, FIG. 1 depicts an embodiment of a preformed smokeless tobacco product 110 having a substantially rectangular cuboidal shape in which the corners are rounded in a longitudinal plane. As such, as shown in FIG. 2A, each of the preformed smokeless tobacco products 110 in the packaging system 100 can have a substantially similar shape. The shape can include at least one pair of opposing, generally parallel exterior surfaces, and as shown in the depicted embodiment, can include three pairs of opposing, generally parallel exterior surfaces. Other shapes are also possible. As used herein, "preformed" means the product is formed into a selected product shape at the time of or prior to the time of packaging. The term "preformed," however, does not exclude products that expand or deform into an altered shape after molding and/or packaging processes.

Briefly, in use, an adult tobacco consumer can remove one of the preformed smokeless tobacco products 110 from the interior space 101 of the container 102 and can place the selected product 110 in the adult tobacco consumer's mouth while the preformed smokeless tobacco product generally retains its preformed shape. In some embodiments, the arrangement of preformed smokeless tobacco products 110 can provide a clearance space along side walls of at least one preformed smokeless tobacco product to permit an adult tobacco consumer to readily grasp the preformed smokeless tobacco product 110. For example, as shown in FIG. 2A, the container 102 can have a clearance space 150 sufficient to allow a consumer's fingers 612 and 614 to grasp opposite end walls of a centrally located preformed smokeless tobacco product 110. In particular embodiments, the clearance space 150 extends for at least 5 mm in the length direction along opposite side walls of the centrally located preformed smokeless tobacco product 110. In some embodiments, the interior space 101 of a sealed container is at least 50% empty in order to provide sufficient clearance space for the adult tobacco consumer to readily grasp at least a first preformed smokeless tobacco product 110 and subsequent preformed smokeless tobacco products 110 without damaging adjacent preformed smokeless tobacco products 110.

An adult tobacco consumer can then place the removed preformed smokeless tobacco product 110 within the adult tobacco consumer's mouth. A portion of the tobacco 115 (e.g., at least the tobacco material exposed along outer surfaces of the product 110) is thereby placed in contact with an inside surface the adult tobacco consumer's oral cavity. In some embodiments, the smokeless tobacco product 110 can maintain its cohesiveness within the adult tobacco consumer's mouth, thus reducing the likelihood of substantial portions of the tobacco 115 breaking away for the remainder of the product 110 and thus "floating" around the mouth, yet providing the adult tobacco consumer with the mouth feel and taste similar to loose smokeless tobacco.

I. Container Structure and Product Arrangements

The preformed smokeless tobacco products can be arranged within a variety of different containers, in a variety of different arrangements. As discussed above, one or more preformed smokeless tobacco products 110 are compressed between a container's lid 104 and a container's base 103 to hinder the movement of the one or more preformed smokeless tobacco products 110 within the container's interior space 101. Accordingly, the container is dimensioned so that it permits one or more preformed smokeless tobacco products 110 to be compressed between the container's lid 104 and the container's base 103 once the container is closed and the newly placed shaped smokeless tobacco products 110' are allowed to expand into the preformed smokeless tobacco products 110. Likewise, products 110 are arranged within the container 102 such that one or more products 110 are compressed between the lid 104 and the base 104 once the shaped smokeless tobacco products 110' expand. FIGS. 2A, 2B, 3A, 3B, and 4 depict exemplary packaging systems 100, 200, and 300 including different arrangements of preformed smokeless tobacco products 110. It should be understood that the base 103 depicted in FIGS. 2A-B has a different height than the base 203 depicted in the FIGS. 3A-B and 4 because the different bases are configured to accommodate multi-layer arrangements (e.g., base 103 that receives two layers of the products 110) and single-layer arrangements (e.g., base 203 that receives a single layer of the products 110). Although specific container and preformed smokeless tobacco product shapes and dimensions are described, other shapes, dimensions, and arrangements are also contemplated.

Figure 2B:
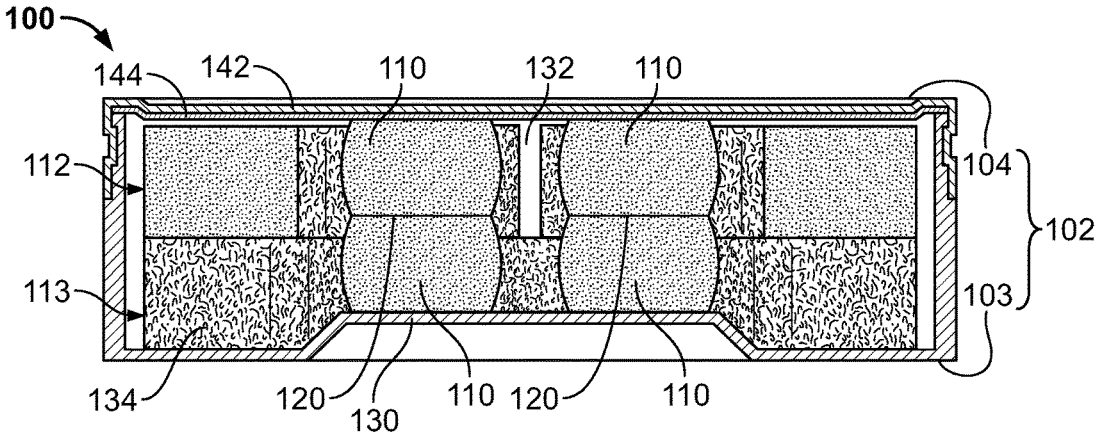
FIG. 2B is a cross-sectional view of a closed container including the arrangement of preformed smokeless tobacco products shown in FIG. 2A.
Figure 3A:
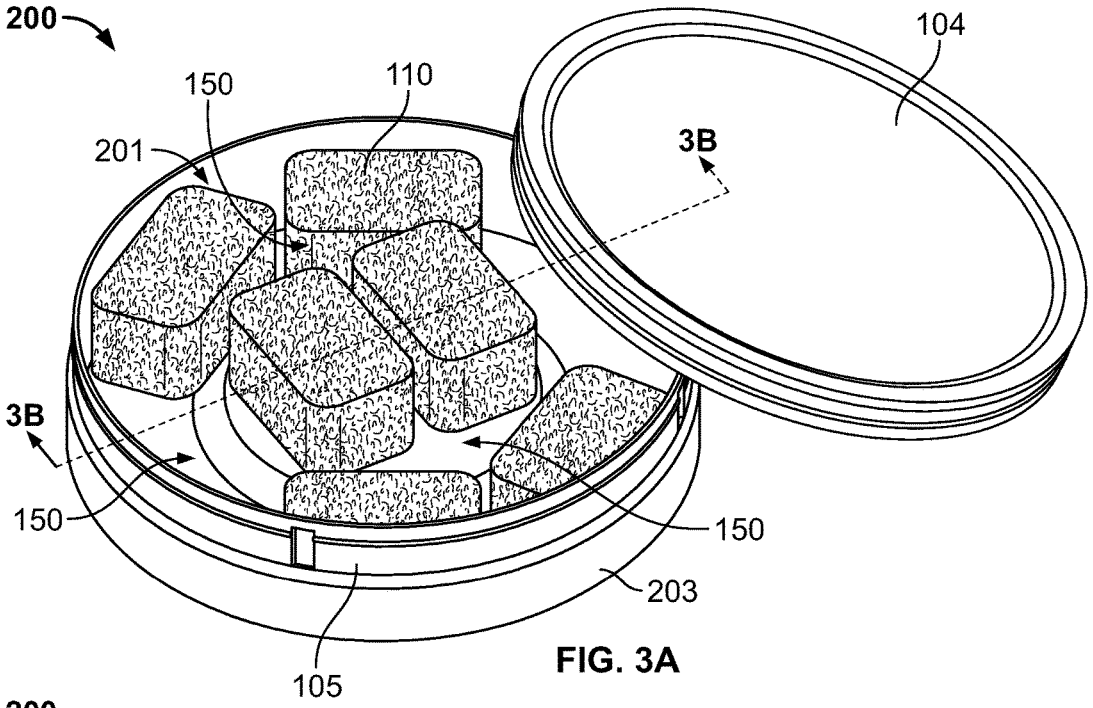
FIG. 3A is a perspective view of an arrangement of preformed smokeless tobacco products within a container according to a second embodiment.
Figure 3B:
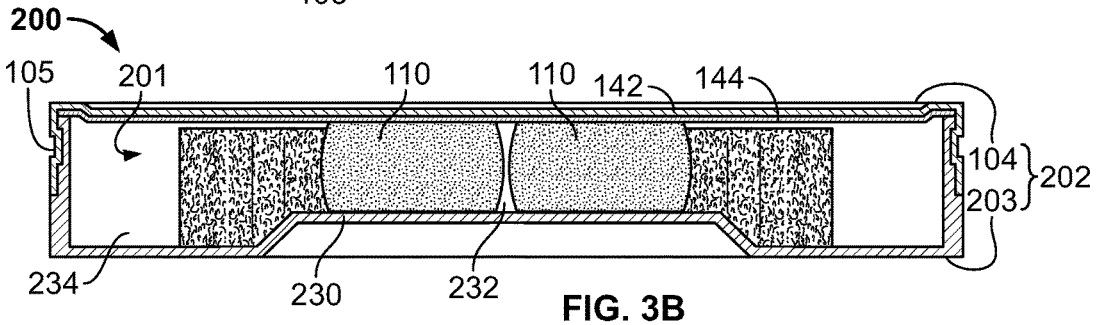
FIG. 3B is a cross-sectional view of a closed container including the arrangement of preformed smokeless tobacco products shown in FIG. 3A.
Figure 4:
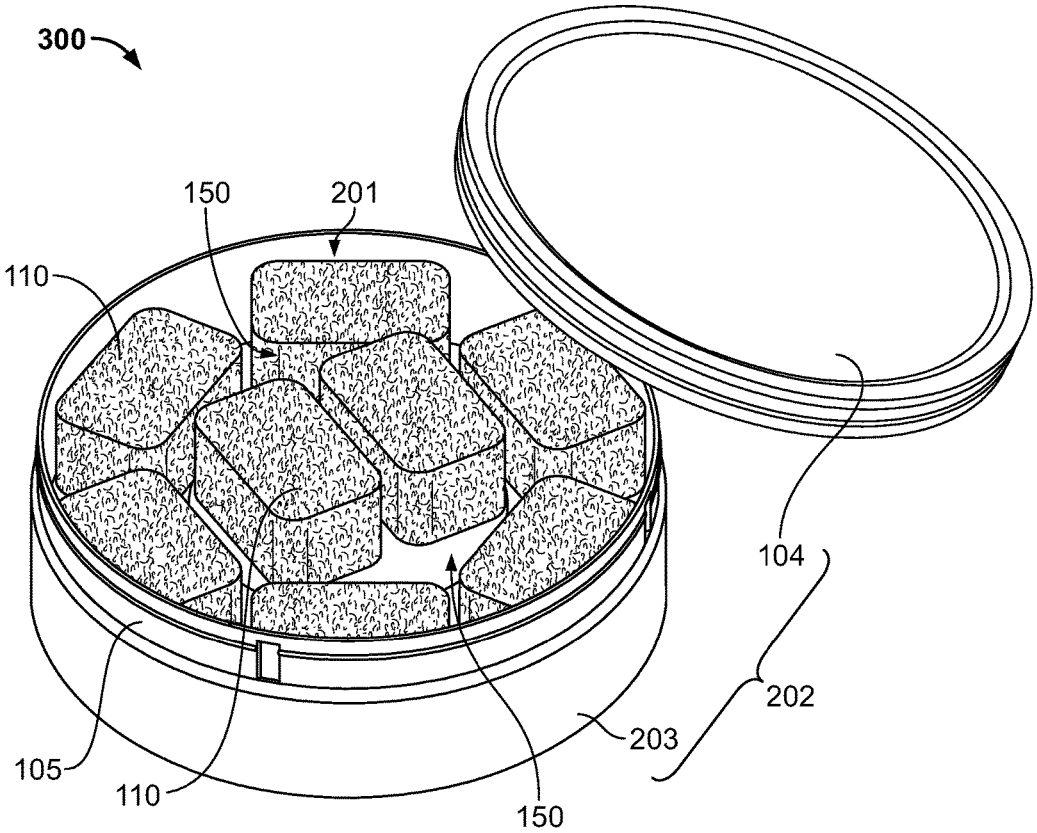
FIG. 4 is a perspective view of an arrangement of preformed smokeless tobacco products within a container according to a third embodiment.

Referring to FIGS. 2A-2B, the base 103 and lid 104 can releasably mate at a connection rim 105 so as to maintain freshness and other product qualities of the preformed smokeless tobacco products 110 contained therein. Such qualities may relate to, without limitation, texture, flavor, color, aroma, mouth feel, taste, ease of use, and combinations thereof. In particular embodiments, the container 102 may have a generally cylindrical shape. The connection rim 105 can be formed on the base 103 to provide a snap-fit engagement with the lid 104. Similarly, as shown in FIGS. 3A-B and 4, the second base 203 can releasably mate with the lid 104 at the connection rim 105 so as to maintain freshness and other product qualities of the preformed smokeless tobacco products 110 contained therein. In these embodiments, the container 202 may have a generally cylindrical shape. As previously described, the connection rim 105 can be formed on the base 203 to provide a snap-fit engagement with the lid 104. In other embodiments, the container 102 can have a generally rectangular shape.

The lid 104 and the base 103 or 203 can include non-stick inner surfaces. A non-stick inner surface can prevent the compressed preformed smokeless tobacco product(s), or a portion thereof, from sticking to the container when an adult tobacco consumer opens the container to retrieve a preformed smokeless tobacco product. Referring to FIGS. 2B and 3B, the lid 104 includes a metal outer layer 142 and a non-stick inner layer 144. In some embodiments, the non-stick inner layer can include a fluorinated fluoropolymer such as polytetrafluoroethylene. In some embodiments, the lid can be punched from a composite blank including a metal layer and a non-stick layer. In some embodiment, the base 103 (or 203) can include a moldable plastic material, such as polyethylene or polypropylene. In some embodiments, the moldable plastic material can be an ultrahigh molecular weight polyethylene or an ultrahigh molecular weight polypropylene.

The packaging systems 100, 200, and 300 described herein can include one or more layers of the preformed smokeless tobacco products 110. Referring to FIGS. 2A and 2B, some embodiments of the packaging system 100 include two layers of preformed smokeless tobacco products 110 with at least one stack 120 of two preformed smokeless tobacco products 110 being compressed between the lid 104 and the base 103 once a stack of shaped smokeless tobacco products 110' have expanded. Referring to FIGS. 3A and 3B, some embodiments of a packaging system 200 include a single layer of preformed smokeless tobacco products 110 with at least one (centrally located) preformed smokeless tobacco product 110 being compressed between the lid 104 and the base 203. Similar, as shown in FIG. 4, particular embodiments of a packaging system 300 include a single layer of preformed smokeless tobacco products 110 (higher quantity than the system 200) with at least one (centrally located) preformed smokeless tobacco product 110 being compressed between the lid 104 and the base 203. In other embodiments, not shown, the packaging system can include three or more layers of preformed smokeless tobacco products 110 with at least one stack including three or more preformed smokeless tobacco products 110 being compressed between the lid 104 and the base 103. In such circumstances, at least the base 103 may be configured to a different height. The compressed preformed smokeless tobacco products 110 (in a stack 120 or standing alone), upon relaxation, exert a force on the inner surfaces of the lid 104 and the base 103 (or 203) and thus hinder the movement of those preformed smokeless tobacco products 110. Accordingly, the compressed preformed smokeless tobacco products 110 (in a or stacks 120 or standing alone) are compressed between the lid 104 and the base 103 (or 203) due to engagement of the lid 104 and the base 103 (or 203) so as to secure the compressed tobacco products 110 in a substantially stationary position within the interior space of the container 102 (or 202). Advantageously, the original positioning of the shaped smokeless tobacco bodies 110' is preserved after expansion to become the preformed smokeless tobacco products 110 for presentation to the adult tobacco consumer upon opening of the can and the consumer and maintain clearance spaces between the bodies/products to facilitate removal of one or more of the preformed smokeless tobacco products 110.

In the embodiment depicted in FIGS. 2A and 2B, the container 102 is dimensioned to receive and retain a plurality of preformed smokeless tobacco products 110, and at least a portion of the container 102 is narrower than the fully relaxed thickness of the stack 120 of preformed smokeless tobacco products 110. As such, at least a portion of the interior space 101 dimensioned to compress two or more preformed smokeless tobacco products 110 (e.g., the stack 120 of two or more preformed smokeless tobacco products 110).

In the embodiments depicted in FIGS. 3A-B and 4, the container 202 is dimensioned to receive and retain a single layer of preformed smokeless tobacco products 110, and at least a portion of the container 202 is narrower than the fully relaxed thickness of an individual preformed smokeless tobacco product 110. In some embodiments, the container has a constant interior space height such that all of the preformed smokeless tobacco products 110 are compressed between the lid and the base.

In other embodiments, the lid 104 or the base 103 (or 203) can include raised and/or recessed portions that provide a varying interior space height. Referring to FIGS. 2A-B, some embodiments of the packaging system 100 include the base 103 having a raised central portion 130. The central portion 132 of the interior space 101 accordingly has a narrower width than the peripheral portion 134 of the interior space 101. Accordingly, one or more preformed smokeless tobacco products 110 positioned in the central portion 132 are compressed between the lid 104 and the base 103. In some embodiments, preformed smokeless tobacco products 110 positioned in the peripheral portion 134 are free to slide relative to the lid 104 and base 103 within the peripheral portion 134. In another example, referring to the embodiments illustrated in FIGS. 3A-B and 4, the packaging system 200 or 300 may include the base 203 having a raised central portion 230. The central portion 232 of the interior space 201 accordingly has a narrower width than the peripheral portion 234 of the interior space 201. Accordingly, one or more preformed smokeless tobacco products 110 positioned in the central portion 232 are compressed between the lid 104 and the base 203. In some embodiments, preformed smokeless tobacco products 110 positioned in the peripheral portion 234 are free to slide relative to the lid 104 and base 203 within the peripheral portion 234. More preferably, in other embodiments, the preformed smokeless tobacco products 110 positioned in the peripheral portion 134 or 234 are, upon their relaxation, compressed between the lid 104 and the base 103 or 203 to hinder movement of the preformed smokeless tobacco products within the peripheral portion 134 or 234. In some embodiments, the amount of compression of the preformed smokeless tobacco products within the central portion 132 or 232 is greater than the amount of compression of the preformed smokeless tobacco products within the peripheral portion 134 or 234. In other embodiments, the base 103 or 203 has a planar bottom wall and all products 110, upon relaxation, are retained in a similar manner between the lid 104 and the base 103.

Referring to FIGS. 2A and 2B, in certain embodiments of the packaging system, multiple layers of preformed smokeless tobacco products can be arranged so that centrally located preformed smokeless tobacco products 110 are oriented in the same direction to create stacks 120, while preformed smokeless tobacco products 110 in a peripheral portion 134 can be layered in an offset manner. In some embodiments, a top layer 112 is arranged so that the top layer provides a clearance space 150 at opposite ends of a centrally located preformed smokeless tobacco product. In some embodiments, the clearance space 150 is at least 5 mm wide. In some embodiments, the clearance space 150 can be at least 10 mm in length (e.g., the dimension perpendicular to the at least 5 mm width). The clearance space 150 can so dimensioned to permit an adult tobacco consumer to readily grasp a centrally located preformed smokeless tobacco product 110 at opposite ends, while avoiding disrupting adjacently located preformed smokeless tobacco products. In some embodiments, the clearance space is sized to allow an average sized adult index finger 614 and thumb 612 to be inserted into the clearance space without disrupting the adjacent preformed smokeless tobacco products.

Still referring to FIGS. 2A and 2B, certain embodiments of the container 102 can have an inner diameter of about 2.47 inches (or about 62.7 mm) and an outer diameter of about 2.59 inches (or about 65.8 mm). The container 102 can have an outer height of about 0.91 inches (or about 23.1 mm), a central portion 132 interior height of about 0.81 inches (or about 20.7 mm), and a peripheral portion 134 interior height of about 0.86 inches (or about 21.8 mm). Two layers 112 and 113 of eight preformed smokeless tobacco products 110 are positioned within the container 102. The preformed smokeless tobacco products can each be formed by mold cavities having a length L of about 0.75 inches (or about 19.0 mm), a width W of about 0.43 inches (or about 11.0 mm), and a thickness T of about 0.39 inches (or about 10.0 mm), which can yield a preformed smokeless tobacco product 110 having a weight of about 2.35 grams. Regarding the dimensions of the preformed smokeless tobacco product 110, the term "length" refers to the longest dimension L of the preformed smokeless tobacco product 110, the term "thickness" refers to the shortest dimension T of the preformed smokeless tobacco product 110, and the term "width" refers to the dimension W generally perpendicular to both the length and the thickness. After each preformed smokeless tobacco product 110 exits the mold cavity, each preformed smokeless tobacco product can relax and thus expand by about 0.04 inches or about 1 mm) in each dimension of length, height, and width. Accordingly, the interior space 101 can be dimensioned such that pre-relaxation preformed smokeless tobacco products 110 can be placed in container 102 and the container closed without pressing the preformed smokeless tobacco products, yet also be dimensioned such that at least the preformed smokeless tobacco products 110 in the central portion 132 relax to become compressed between the lid 104 and the base 103. In some embodiments, peripherally placed preformed smokeless tobacco products can be placed to contact a portion of a raised central portion 130 and thus become compressed between a peripheral portion of the raised central portion 130, a side wall 136 of the base 103, and the lid 104.

Referring to FIGS. 3A, 3B, and 4, in certain embodiments of the packaging system 200 and 300, a single layer of preformed smokeless tobacco products 110 can be arranged so that two centrally located preformed smokeless tobacco products 110 are each compressed between the lid 104 and the base 203. The container 202 illustrated in each of FIGS. 3A, 3B, and 4 can have an inner diameter of about 2.47 inches (or about 62.7 mm), an outer diameter of about 2.59 inches (or about 65.8 mm), an outer height of about 0.64 inches (or about 16.3 mm), a central portion 132 interior height of about 0.48 inches (or about 12.2 mm), and a peripheral portion 134 interior height of about 0.58 inches (or about 14.7 mm). The preformed smokeless tobacco products can each be formed by mold cavities having a length of about 0.75 inches (or about 19.0 mm), a width of about 0.43 inches (or about 11.0 mm), and a thickness of about 0.39 inches (or about 10.0 mm), which can yield a preformed smokeless tobacco product having a weight of about 2.35 grams. After each preformed smokeless tobacco product exits the mold cavity, each preformed smokeless tobacco product can relax and thus expand by about 0.04 inches (or about 1 mm) in each dimension. Accordingly, the interior space 201 can be dimensioned such that pre-relaxation preformed smokeless tobacco products 110 can be placed in container 202 and the container closed without pressing the preformed smokeless tobacco products, yet also be dimensioned such that at least the preformed smokeless tobacco products 110 in the central portion 232 relax to become compressed between the lid 104 and the base 203. Preferably, all products 110 are at least partially subject to compression.

In the embodiment of the packaging system 200 shown in FIG. 3A, the container 202 can include six pieces of the preformed smokeless tobacco products 110 and can provide a clearance space 150 for grasping opposite sides of the centrally located preformed smokeless tobacco products. In the alternative embodiment of the packaging system 300 shown in FIG. 4, the container 202 can also include eight pieces and can be arranged to provide a clearance space 150 for grasping opposite sides of the centrally located preformed smokeless tobacco products 110.

In certain embodiments, the packaging system 100, 200, or 300 can have a void space within the container 102 or 202 of at least 30 percent by volume. In some embodiments, the void space within the container 102 or 202 is at least 40 percent. In still other embodiments, the void space within the container 102 or 202 is at least 50 percent. For example, the packaging system 100 of FIGS. 2A and 2B includes a void space in the container 102 of about 53 percent. The packaging system 200 of FIGS. 3A and 3B includes a void space in the container 202 of about 68 percent. The packaging system 300 of FIG. 4 includes a void space in the container 202 of about 57 percent. Although different arrangements of preformed smokeless tobacco products 110 could increase the number that would fit within a container, the arrangements described herein can permit an adult tobacco consumer to readily access the preformed smokeless tobacco products 110 within the container 102 without disrupting adjacent preformed smokeless tobacco products 110.

II. Molding & Packaging

Figure 5:
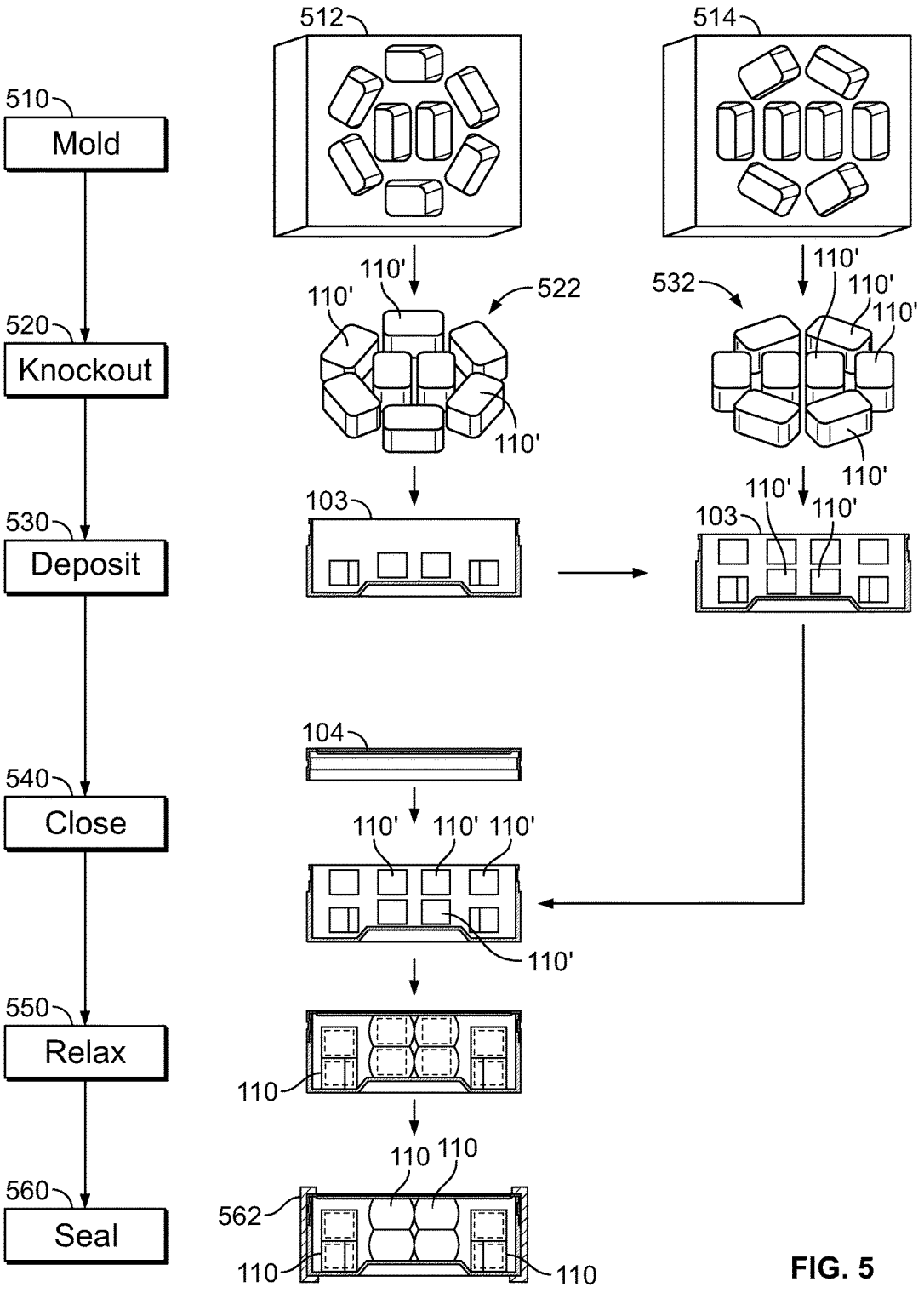
FIG. 5 is a flow chart and schematic depicting an exemplary method of forming and packaging the shaped smokeless tobacco bodies.

Referring now to FIG. 5, some embodiments of the method of making and packaging the preformed smokeless tobacco products 110 into a container include the steps of molding 510, depositing 530, closing 540, and sealing 560. Arrangements of shaped smokeless tobacco bodies 522 and 524 can be separated from the mold in a knockout step 520. Moreover, the shaped smokeless tobacco bodies 110' can relax after the container is closed during a relaxation period 550. Although the relaxation period 550 is illustrated in FIG. 5 as occurring before the sealing step 560, it should be understood that the relaxation period 550 may occur before the sealing step 560, concurrently with the sealing step 560, after the sealing step 560, or a combination thereof.

The mold process 510 can include mixing the tobacco 115, the binder, and any flavorants or other additives together and shaping the mixture into the predetermined shape. As shown in FIG. 5, the molding plates 512 and 514 can be used to mold the smokeless tobacco products of different layers in a desired configuration. In some embodiments, each set of mold cavities can be arranged to correspond to the desired arrangement of the preformed smokeless tobacco products 110 within the closed and/or sealed container 102. The mixture of tobacco and binder can be extruded into the mold cavities. In some embodiments, 50-300 lbs of injection pressure is used to deliver the mixture into the plurality of mold cavities. In some embodiments, a pressure range of 130-170 lbs of injection pressure is used to deliver the mixture into the plurality of mold cavities. The mold cavities can be filled using continuous or intermittent pressure. For example, a screw pump can be used to apply the pressure to the mixture. In certain embodiments, the smokeless tobacco products can be molded using a former machine, such as a FORMAX F-19 former machine or a FORMAX F-6 former machine. Some industrial processors, such as those sold by FORMAX of Mokena, Ill., can be used at rates of up to sixty strokes/minute, with each stroke producing multiple sets of shaped smokeless tobacco bodies 110'.

In some embodiments, the mold cavities have a volume sized to create formed shaped smokeless tobacco bodies 110' having a mass of about 2.35 grams. The edges and corners of the mold cavities can be rounded to permit the formed body to be easily released from the mold. Although the arrangements shown in FIG. 5 for different layers are shown as being within different molding plates 512 and 514, a single molding plate can include multiple sets of different arrangements for different layers and/or containers. The molding plates 512 and 514 can include a bottom wall defined by a back plate. After the tobacco/binder mixture is pressed (e.g., extruded) into the mold cavities, the back plate can be moved relative to the molding plate 512 or 514 to allow the shaped smokeless tobacco bodies 110' to pass though the molding plates 512 or 514. In some embodiments, the molding plates 512 and 514 can include a cutter that horizontally slices tobacco material within each mold cavity to produce multiple shaped smokeless tobacco bodies 110' per mold cavity in a single molding operation. The molding plates 512 or 514 can be made from materials selected from the group of plastics, metals, woods, or combinations thereof. For example, the mold plates 512 or 514 can be made of stainless steel, aluminum, polypropylene, or polyethylene. In some embodiments, the molding plates can include non-stick coatings, such as PTFE.

Prior to molding, tobacco can be cured and added to a mixer. For example, tobacco can be long cut fire-cured tobacco having an oven volatiles content of 48-50 weight percent. A binder can be mixed with the tobacco. The binder can be TICALOID LITE Powder. One or more flavorants and/or other additives can also be mixed with the binder and tobacco. For example, the flavorants and other additives can include, for example, a mint flavoring, a sweetener, and a pH modifier. The mixing can occur in any commercially available countertop mixer or industrial mixer, for example a HOBART 40 lbs mixer or a FORBERG 250 lbs Paddle Mixer. Water can be added to the tobacco prior to or during the mixing process to alter the total oven volatiles content of the final smokeless tobacco product. The oven volatiles content can also be modified by heating the mixture. In other embodiments, a commercially available smokeless tobacco product (e.g., Copenhagen® Long Cut) can be mixed with a binder (e.g., TICALOID LITE Powder) to form the mixture.

The molding process can also be used to emboss the shaped smokeless tobacco bodies 110'. For example, the preformed smokeless tobacco product 110N can be embossed or stamped with any type of design including, but not limited to, a trademark, a product name, or any type of image. Additionally, the mold cavities 516 can be used to apply flavor strips or other preformed structures to one or more surfaces of the shaped smokeless tobacco bodies.

Externally located flavor strips can provide an adult tobacco consumer with an initial burst of flavor. For example, a flavor strip can be an edible or dissolvable film, which may be substantially transparent or translucent. The dissolvable film can readily dissipate when the smokeless tobacco product 110 is placed in an adult tobacco consumer's mouth thereby providing the adult tobacco consumer with the tactile feel of the tobacco 115 along the exterior of the product 110.

Once molded, the shaped smokeless tobacco bodies are ejected from the molding plates 512 or 514 and deposited in the container 102. In certain embodiments, the shaped smokeless tobacco bodies 110' are separated from the mold using a knockout in step 520. In some embodiments, the shaped bodies are knocked out and deposited directly into the container 102 in a depositing process 530. As shown in FIG. 5, a two layered arrangement can include depositing a first layer 522 into a container followed by depositing the second layer 524 directly on top of the first layer within the same container. As shown, the layers 522 and 524 are deposited into the container's base. In other embodiments, however, the layers can be deposited onto the lid 104 followed by applying the base 103 to the lid 104 to deposit the shaped smokeless tobacco bodies within the container 102. In other embodiments, shaped smokeless tobacco bodies can be deposited on to an indexing conveyor during a knockout process and arranged and deposited into a container 102 in a desired configuration. An indexing conveyor can be used to eliminate bodies that do not conform to quality control standards before the remaining products are placed in the container 102. In some embodiments, separators (e.g., wax paper) could be used to separate adjacent layers. The shaped smokeless tobacco bodies can be deposited in the container's base 103 prior to the full relaxation of the bodies.

After the shaped smokeless tobacco bodies 110' are deposited within the interior space 101 of container 102, a lid 104 is mated with the connection rim 105 of the container 102 in a closing process 540. The container 102 is closed before the shaped smokeless tobacco bodies 110 fully relax. Accordingly, once the container is closed, the shaped smokeless tobacco bodies 110 can expand to become compressed between the lid 104 and the base 103 during a relaxation period 550. The relaxation can occur before, after, or concurrently with a sealing process 560. In some embodiments, full expansion occurs within about 24 hours. A label can be applied to the closed container system 100 (e.g., applied to the outer cylindrical sidewalls of the container 102 and the lid 104) during the sealing process 560. Shrink wrap 562 can also be applied to the closed container system 100 to seal the container. A plurality of filled, labeled, and shrink wrapped packaging systems 100 can then be placed in a box and shipped to a retail location.

Each preformed smokeless tobacco product 110 can experience significant jarring movements during the shipping of the containers 102 to retail locations, stocking the containers 102 at a retail location, and having an adult tobacco consumer purchase and carry around the container 102. Accordingly, the packaging techniques described herein, along with the relaxation and expansion features of the preformed smokeless tobacco products, are selected such that preformed smokeless tobacco products 110 maintain integrity until an adult tobacco consumer uses the products.

III. Method of Use

Referring back to FIG. 2A, the preformed smokeless tobacco product 110 can be used by removing a preformed smokeless tobacco product 110 from the container 102 and placing the intact preformed smokeless tobacco product in the adult tobacco consumer's mouth. For example, the adult tobacco consumer can open the container 102 by removing the lid 104. When the adult tobacco consumer removes a preformed smokeless tobacco product 110 from the interior space 101 of the container 102, the adult tobacco consumer can grip the preformed smokeless tobacco product 110 between the adult tobacco consumer's thumb 612 and the index finger 614 and/or another finger. The preformed smokeless tobacco product 110 retains its integrity as it is gripped with moderate pressure. As shown in FIG. 2A, the arrangement of preformed smokeless tobacco products 110 includes a clearance space 150 on opposite sides of centrally located preformed smokeless tobacco products 110, thus the adult tobacco consumer can grip the preformed smokeless tobacco product 110 without disrupting the adjacent preformed smokeless tobacco products 110. It should be understood from the description herein that a preformed smokeless tobacco products 110 can be removed from the container 202 (illustrated in the embodiments in FIGS. 3A-B and 4) in a substantially similar manner.

The adult tobacco consumer can insert one or more of the preformed smokeless tobacco products 110 into the adult tobacco consumer's mouth. For example, the adult tobacco consumer can place the preformed smokeless tobacco product 110 between the adult tobacco consumer's lip and gingiva (the gums). Because of the material properties described herein, the products 110 retain their integrity during the gripping and placing processes. After the product 110 is inserted in the mouth, the products 110 can directly contact the inside of the adult tobacco consumer's oral cavity. The adult tobacco consumer can also apply pressure to the preformed smokeless tobacco product 110 to conform the smokeless tobacco product to the contours of the oral cavity. For example, the adult tobacco consumer can compress the preformed smokeless tobacco product between the lip and the gingiva. Pressing the smokeless tobacco product can also loosen the tobacco, thus retaining the flavor and mouth feel experience of loose smokeless tobacco. Even as the smokeless tobacco product loosens, the smokeless tobacco product can retain some cohesion and thus reduce the instances of substantial pieces of tobacco and binder separating from the remainder of the preformed smokeless tobacco product and "floating" within adult tobacco consumer's mouth. Moreover, the presence of the binder in the preformed smokeless tobacco product, however, can also enhance the flavor experience by increasing the duration of the flavor release as compared to loose smokeless tobacco.

IV. Friability

In some embodiments, the material properties of the preformed smokeless tobacco products 110 described herein provide enhanced tobacco satisfaction. In particular, the material properties can improve handling, mouth feel, and flavor release. In certain embodiments, the material properties of one or more of the preformed smokeless tobacco products 110 can be defined in terms of individual product friability. In addition, the packaging can protect the preformed smokeless tobacco products 110 from being damaged prior to being used by an adult tobacco consumer. The properties of the packaging, therefore, can be defined in terms of whole-package friability.

Friability is a measurement of the ability of an object to be reduced to smaller pieces when subjected to pressure or friction. A numerical value for friability is dependent on the specific test used. The friability of a product can be tested both alone and in combination with its package. As used herein, "individual product friability" is the weight percent of material lost due to the placement of an individual preformed smokeless tobacco product within a friability drum and rotated at 25 rpm for 100 revolutions, which is equal to four (4) minutes of rotation. As used herein, "whole-package friability" is the average weight percent of material lost from the preformed smokeless tobacco products 110 within a package (e.g., container 102) due to the placement of the package containing the plurality of preformed smokeless tobacco products within a friability drum and rotated at 25 rpm for 100 revolutions. A friability drum is a standard friability drum with a diameter of 152 mm. For example, a standard friability drum meeting USP, EUR, and DAB pharmacopoeia standards, such as the Erweka GmbH D63159 friability tester having a standard USP 100 Method friability drum, can be used to test the preformed smokeless tobacco product 110.

The preformed smokeless tobacco product 110 may have an individual product friability of at least 0.5 weight percent to increase the likelihood of a good mouth feel and flavor release. Although a non-friable product (e.g., a product having an individual product friability of approximately zero) has good product integrity, a non-friable product does not provide a mouth feel or flavor release that is similar to loose smokeless tobacco. Accordingly, in particular embodiments, an individual product friability of at least 0.5 weight percent can allow the product to partially conform to the contours of an adult tobacco consumer's mouth (e.g., to the contours between a lip and a gingiva). An individual product friability of at least 0.5 weight percent can also permit different portions of the tobacco within the product to make contact with the adult tobacco consumer's mouth tissue. In some embodiments, the preformed smokeless tobacco product 110 has an individual product friability of at least 1.0 weight percent. In still other embodiments, the preformed smokeless tobacco product 110 has an individual product friability of at least 1.5 weight percent. In certain embodiments, the individual product friability of each preformed smokeless tobacco product 110 can be greater than 1.7 weight percent.

In particular embodiments, the preformed smokeless tobacco products 110 can each have an individual product friability of less than 80 weight percent to increase the likelihood that each of the products 110 can be packaged, shipped, stocked, purchased, carried, and handled prior to use without significantly falling apart or otherwise significantly deteriorating from their original shapes and tobacco content. In some embodiments, the preformed smokeless tobacco product 110 has an individual product friability of less than 60 weight percent. In some embodiments, the preformed smokeless tobacco product 110 has an individual product friability of less than 40 weight percent. In still other embodiments, the preformed smokeless tobacco product 110 has an individual product friability of less than 20 weight percent. The preformed smokeless tobacco product 110 can also have an individual product friability of less than 10 weight percent. In some embodiments, the individual product friability of each preformed smokeless tobacco product 110 is less than 4 weight percent. For example, the individual product friability of each preformed smokeless tobacco product 110 can be less than 2.1 weight percent.

A friable preformed smokeless tobacco product can result in material loss within the package prior to use by an adult tobacco consumer. The arrangement of the preformed smokeless tobacco products 110 within a container 102 as described herein, however, can reduce the amount of material loss. In some embodiments, the system 100 has a whole-package friability of less than 10 weight percent. In some embodiments, the system's whole-package friability is less than 5 weight percent. In some embodiments, the system's whole-package friability is less than 1 weight percent. In some embodiments, the system's whole-package friability is less than 0.5 weight percent. The arrangement of the preformed smokeless tobacco products within the container 102 as described herein can result in a whole-package friability of less than the individual product friability of the preformed smokeless tobacco products within the container. Although the container 102 protects preformed smokeless tobacco products from the surface of the friability drum, a loose interaction between the preformed smokeless tobacco products within the container during the tumbling of the container can result in material loss for the preformed smokeless tobacco products as they bump against each other and/or the container walls. By having one or more preformed smokeless tobacco products compressed between the lid and the base and thus hindering or restricting the movement of the one or more preformed smokeless tobacco products, the system's whole-package friability can be reduced.

IV. Product Constituents

Some embodiments of the preformed smokeless tobacco product 110 include tobacco and a binder. The product 110 can optionally include one or more flavorants and other additives. The particular composition, in large part, determines the material properties of the preformed smokeless tobacco product 110.

Tobacco

Any tobacco suitable for use in a smokeless tobacco product can be used. By "tobacco" it is meant a part, e.g., leaves, flowers, and stems, of a member of the genus *Nicotiana*. Exemplary species of tobacco include *N. rustica, N. tabacum, N. tomentosiformis*, and *N. sylvestris*. Suitable tobaccos include fermented and unfermented tobaccos, dark air-cured, dark fire cured, burley, flue cured, and cigar filler or wrapper, as well as the products from the whole leaf stemming operation. For example, tobacco can be conditioned by heating, sweating and/or pasteurizing steps as described in U.S. Publication Nos. 2004/0118422 or 2005/0178398. Fermenting typically is characterized by high initial moisture content, heat generation, and a 10 to 20% loss of dry weight. See, e.g., U.S. Pat. Nos. 4,528,993; 4,660,577; 4,848,373; and 5,372,149. In addition to modifying the aroma of the leaf, fermentation can change either or both the color and texture of a leaf. Also during the fermentation process, evolution gases can be produced, oxygen can be taken up, the pH can change, and the amount of water retained can change. See, for example, U.S. Publication No. 2005/0178398 and Tso (1999, Chapter 1 in *Tobacco: Production, Chemistry and Technology*, Davis & Nielsen, eds., Blackwell Publishing, Oxford). Cured, or cured and fermented tobacco can be further processed (e.g., cut, expanded, blended, milled or comminuted) prior to incorporation into a preformed smokeless tobacco product. The tobacco, in some embodiments, is long cut moist tobacco having an oven volatiles content of between 48 and 50 weight percent prior to mixing with the binder and optionally flavorants and other additives.

The tobacco can, in some embodiments, be prepared from tobacco leafs from a tobacco plants having less than 20 μg of DVT per $cm^2$ of green leaf tissue. For example, the tobacco can be selected from the tobaccos described in U.S. Patent Publication No. 2008/0209586, which is hereby incorporated by reference. Tobacco compositions containing tobacco from such low-DVT varieties exhibits improved flavor characteristics in sensory panel evaluations when compared to tobacco or tobacco compositions that do not have reduced levels of DVTs.

Binder

Binders suitable for use in the preformed smokeless tobacco product described herein include orally compatible polymers, such as cellulosics (e.g., carboxymethyl cellulose (CMC), hydroxypropyl cellulose (HPC), hydroxyethyl cellulose (HEC), hydroxypropyl methyl cellulose (HPMC), and methyl cellulose (MC)); natural polymers (e.g., starches and modified starches, konjac, collagen, inulin, soy protein, whey protein, casein, and wheat gluten); seaweed-derived polymers (e.g., carrageenan (kappa, iota, and lambda); alginates, (and propylene glycol alginate), microbial-derived polymers (e.g., xanthan, dextrin, pullulan, curdlan, and gellan); extracts (e.g., locust bean gum, guar gum, tara gum, gum tragacanth, pectin (lo methoxy and amidated), agar, zein, karaya, gelatin, psyllium seed, chitin, and chitosan), exudates (e.g., gum acacia (arabic) and shellac), synthetic polymers (e.g., polyvinyl pyrrolidone, polyethylene oxide, and polyvinyl alcohol)).

The binder, in some embodiments, is guar gum, xanthan, cellulose, or a combination thereof. The cellulose can be carboxymethyl cellulose (CMC). Guar gum, xanthan, CMC, and some combinations thereof can be obtained from, for example, TIC Gums Inc., located in White Marsh, Md. and at ticgums.com on the World Wide Web. Guar gum is sold by TIC Gums Inc. under the trade name GUARNT. Carboxymethyl cellulose (CMC) is sold by TIC Gums Inc. under the trade name TICALOSE. Xanthan is sold by TIC Gums Inc. under the trade name TICAXAN. TIC Gums Inc. also sells some mixed binders, such as the mixed binder systems sold under the trade names TICALOID and TICAFILM. In some embodiments, TICALOID LITE Powder is used as the binder in the preformed smokeless tobacco products.

The binder can be present in amounts that allow the preformed smokeless tobacco product 110 to have the material properties described herein. The specific amount of binder used to achieve the particular material properties can depend, in part, on the type of binder used. In some embodiments, the preformed smokeless tobacco product 110 includes at least 0.5 weight percent binder, which can increase the likelihood that the preformed smokeless tobacco product 110 maintains its integrity during packaging and transport. The preformed smokeless tobacco products 110 have, in some embodiments, less than 5.0 weight percent binder. In some embodiments, the binder of each preformed smokeless tobacco product 110 is between 0.5 and 2.0 weight percent of the preformed smokeless tobacco product. The binder of each preformed smokeless tobacco product 110 can also be in an amount of between 0.5 and 1.5 weight percent.

Flavorants and Other Components

In some embodiments, the preformed smokeless tobacco product 110 can optionally include one or more flavorants. For example, suitable flavorants include wintergreen, cherry and berry type flavorants, various liqueurs and liquors such as Dramboui, bourbon, scotch, whiskey, spearmint, peppermint, lavender, cinnamon, cardamon, apium graveolents, clove, cascarilla, nutmeg, sandalwood, bergamot, geranium, honey essence, rose oil, vanilla, lemon oil, orange oil, Japanese mint, cassia, caraway, cognac, jasmin, chamomile, menthol, ilangilang, sage, fennel, piment, ginger, anise, coriander, coffee, liquorish, and mint oils from a species of the genus *Mentha*. Mint oils useful in particular embodiments of the preformed smokeless tobacco product 110 include spearmint and peppermint.

The preformed smokeless tobacco product 110 may optionally include other additives. Other additives include fillers (e.g., starch, di-calcium phosphate, lactose, sorbitol, mannitol, and microcrystalline cellulose), soluble fiber (e.g., Fibersol from Matsushita), calcium carbonate, dicalcium phosphate, calcium sulfate, and clays), lubricants (e.g., lecithin, stearic acid, hydrogenated vegetable oil, mineral oil, polyethylene glycol 4000-6000 (PEG), sodium lauryl sulfate (SLS), glyceryl palmitostearate, sodium benzoate, sodium stearyl fumarate, talc, and stearates (e.g., Mg or K), and waxes (e.g., glycerol monostearate, propylene glycol monostearate, and acetylated monoglycerides)), plasticizers (e.g., glycerine, propylene glycol, polyethylene glycol, sorbitol, mannitol, triacetin, and 1,3 butane diol), stabilizers (e.g., ascorbic acid and monosterol citrate, BHT, or BHA), artificial sweeteners (e.g., sucralose, saccharin, and aspartame), disintegrating agents (e.g., starch, sodium starch glycolate, cross caramellose, cross linked PVP), pH stabilizers, or other compounds (e.g., vegetable oils, surfactants, and preservatives). Some compounds display functional attributes that fall into more than one of these categories. For example, propylene glycol can act as both a plasticizer and a lubricant and sorbitol can act as both a filler and a plasticizer. Water and other oven volatiles can also be added during a mixing process (discussed below) to alter the total oven volatiles content of the formed smokeless tobacco product 110. Various salts can also be added.

The type and amount of flavorants and other additives can also impact the material properties of the preformed smokeless tobacco product. In some embodiments, the amount of flavorants and other additives in the preformed smokeless tobacco product 110 are limited to less than 10 weight percent in sum. In some embodiments, the amount of flavorants in the preformed smokeless tobacco product 110 are limited to be less than 5 weight percent in sum. For example, certain flavorants can be included in the preformed smokeless tobacco product 110 in amounts of about 3 weight percent or less.

In some embodiments, the combination of tobacco, flavorants, and other additives used in the preformed smokeless tobacco product 110 can be the mixture of tobacco, flavorants, and other additives commercially sold as smokeless tobacco. For example, the tobacco can be the smokeless tobacco sold under the trade name SKOAL (e.g., SKOAL Long Cut), which includes flavorants and other additives.

Oven Volatiles

Some embodiments of the preformed smokeless tobacco product 110 can have a total oven volatiles content of between 10 and 61 weight percent. The oven volatiles include water and other volatile compounds, which can be a part of the tobacco, the binder, the flavorants, and/or other additives. As used herein, the "oven volatiles" are determined by calculating the percentage of weight loss for a sample after drying the sample in a pre-warmed forced draft oven at 110° C. for 3.25 hours. The binder may absorb some of the oven volatiles during the mixing process and forming process. In some embodiments, the oven volatiles content of the preformed smokeless tobacco product 110 is between 50 and 61 weight percent. For example, the oven volatiles content of each preformed smokeless tobacco product 110 can be about 57 weight percent. In other embodiments, the oven volatiles content can be between 10 and 30 weight percent to provide a snus-like preformed smokeless tobacco product.

It is to be understood that, while the systems, products, compositions of matter, and methods have been described herein in conjunction with a number of different embodiments, the foregoing description of the various embodiments is intended to illustrate and not limit the scope of the systems, products, compositions of matter, and methods. Other embodiments, advantages, and modifications are within the scope of the following claims.

What is claimed is:

1. A method of packaging a smokeless tobacco product:

compressing a mixture of tobacco and a binder into a plurality of shaped smokeless tobacco bodies, each shaped smokeless tobacco body having a substantially similar predetermined shape, each shaped smokeless tobacco body adapted to expand to an expanded size after being compressed;

depositing a plurality of the shaped smokeless tobacco bodies into a base of a container in a predefined layer arrangement, said plurality of shaped smokeless tobacco bodies being in a compressed state during said depositing step; and connecting a lid to the base to close the container before each shaped smokeless tobacco body expands to said expanded size, the plurality of bodies subsequently expanding within the container to become preformed smokeless tobacco products such that one or more of the preformed smokeless tobacco products are compressed between the base and the lid to secure said one or more of the preformed smokeless tobacco products in a substantially stationary position relative to the base and the lid.

2. The method of claim 1, wherein the mixture of tobacco and the binder are compressed into the plurality of shaped smokeless tobacco bodies in a plurality of mold cavities and each of the plurality of shaped smokeless tobacco bodies are configured to expand after being ejected from the mold cavities.

3. The method of claim 2, wherein the plurality of mold cavities are formed in a mold plate and are arranged in a configuration corresponding to an arrangement of the plurality of shaped smokeless tobacco bodies deposited in the base of the container.

4. The method of claim 3, wherein the plurality of mold cavities are placed above the base and the plurality of shaped smokeless tobacco bodies are ejected from the mold cavities and deposited directly into the base.

5. The method of claim 3, wherein the plurality of mold cavities are placed above the lid and the plurality of shaped smokeless tobacco bodies are ejected onto the lid are deposited into the base of the container by connecting the lid to the base.

6. The method of claim 1, further comprising sealing the container.

7. The method of claim 1, wherein the base includes a raised central portion.

8. The method of claim 1, wherein a plurality of layers of shaped smokeless tobacco bodies are deposited into the base and at least one stack of multiple shaped smokeless tobacco bodies expands to become a stack of preformed smokeless tobacco products compressed between the lid and the base.

9. The method of claim 1, wherein each of the shaped smokeless tobacco bodies are compressed into a shape having at least one pair of opposing, generally parallel exterior surfaces.

10. The method of claim 1, wherein each of the preformed smokeless tobacco products comprises between 0.5 weight percent binder and 5.0 weight percent binder.

11. The method of claim 1, wherein the tobacco is long cut tobacco.

12. A method of packaging a product:

compressing a mixture of product constituents into a plurality of shaped bodies, each shaped body adapted to expand to an expanded size after being compressed;

depositing the plurality of shaped bodies into a container in a predefined arrangement, said plurality of shaped bodies being in a compressed state during said depositing step; and closing the container before each of the plurality of shaped bodies expands to said expanded size, the plurality of shaped bodies subsequently expanding within the container such that one or more of the plurality of shaped bodies urge against opposite walls of the container to hinder movement of the one or more of the plurality of shaped bodies within the container.

13. The method of claim 12, wherein the mixture of product constituents comprises tobacco and a binder.

14. The method of claim 12, wherein the mixture of product constituents are compressed into the plurality of shaped bodies in a plurality of mold cavities and the plurality of shaped bodies are configured to expand after being ejected from the mold cavities.

15. The method of claim 12, wherein the plurality of mold cavities are formed in a mold plate and are arranged in a configuration corresponding to an arrangement of the plurality of shaped bodies deposited in a base of the container.

16. The method of claim 15, wherein the plurality of mold cavities are placed above the base and the plurality of shaped bodies are ejected from the mold cavities and deposited directly into the base.

17. The method of claim 15, wherein the plurality of mold cavities are placed above a lid and the plurality of shaped bodies are ejected onto the lid are deposited into the base of the container by connecting the lid to the base.

18. The method of claim 12, further comprising sealing the container.

19. The method of claim 15, wherein the base includes a raised central portion.

20. The method of claim 12, wherein a plurality of layers of shaped bodies are deposited into a base and at least one stack of multiple shaped bodies expands to become a stack of preformed products compressed between a lid and the base.

21. The method of claim 12, wherein each of the plurality of shaped bodies are compressed into a shape having at least one pair of opposing, generally parallel exterior surfaces.

22. The method of claim 20, wherein each of the preformed products comprises between 0.5 weight percent binder and 5.0 weight percent binder.

23. The method of claim 12, wherein the tobacco is long-cut tobacco.

24. A system comprising:

a container including a lid and a base that defines an interior space; and a plurality of preformed smokeless tobacco products having a substantially similar shape and being disposed in the interior space of the container, each of the plurality of preformed smokeless tobacco products comprising moist smokeless tobacco and a binder, one or more of the plurality of preformed smokeless tobacco products being compressed between the lid and the base in response to engagement of the lid and the base so as to secure said one or more plurality of preformed smokeless tobacco products in a substantially stationary position within the interior space.

* * * * *